US008321979B2

(12) United States Patent
Goodwin

(10) Patent No.: US 8,321,979 B2
(45) Date of Patent: Dec. 4, 2012

(54) DEVICES, SYSTEMS AND METHODS RELATING TO SEATING CUSHIONS FOR ALLEVIATION OF HEMORRHOIDS AND OTHER PURPOSES

(76) Inventor: Robert W. Goodwin, Bellingham, WA (US)

( * ) Notice: Subject to any disclaimer, the term of this patent is extended or adjusted under 35 U.S.C. 154(b) by 0 days.

(21) Appl. No.: 13/226,243

(22) Filed: Sep. 6, 2011

(65) Prior Publication Data

US 2012/0255127 A1 Oct. 11, 2012

Related U.S. Application Data

(60) Provisional application No. 61/473,629, filed on Apr. 8, 2011.

(51) Int. Cl.
*A47C 27/12* (2006.01)
*A47G 9/00* (2006.01)

(52) U.S. Cl. ..... 5/653; 5/652

(58) Field of Classification Search ..... 5/653, 652, 5/655, 645, 636, 632, 490
See application file for complete search history.

(56) References Cited

U.S. PATENT DOCUMENTS 1,312,886 A * 8/1919 Bawden ..... 5/645
1,960,474 A * 5/1934 Browne ..... 441/129
2,552,476 A * 5/1951 Barton ..... 5/653
3,089,153 A * 5/1963 Bosc ..... 5/710
5,038,432 A * 8/1991 Robillard et al. ..... 5/645
5,279,237 A * 1/1994 Alivizatos ..... 112/475.05
5,367,731 A * 11/1994 O'Sullivan ..... 5/645
5,813,066 A * 9/1998 Gebhard et al. ..... 5/655
6,029,295 A * 2/2000 Larmour et al. ..... 5/636
6,857,150 B2 * 2/2005 Matthews Brown et al. ..... 5/655
7,000,275 B2 * 2/2006 Matthews Brown et al. ..... 5/655
7,426,762 B2 * 9/2008 Dazzi ..... 5/632
7,926,134 B2 * 4/2011 Carlos ..... 5/645
2005/0000023 A1 * 1/2005 Brown et al. ..... 5/655
2005/0125902 A1 * 6/2005 Matthews Brown et al. ..... 5/655
2007/0089240 A1 * 4/2007 Dazzi ..... 5/630
2007/0118992 A1 * 5/2007 Carlos ..... 5/645

* cited by examiner

*Primary Examiner* — Robert G Santos

(74) *Attorney, Agent, or Firm* — Graybeal Jackson LLP

(57) ABSTRACT

A toroidal cushion sized to fit and support a posterior of a human user. The toroidal cushion slopes significantly from the back toward the front and comprises an upper cushion surface comprising a depressed center within a surrounding upper cushion surface. The depressed center and the surrounding upper cushion surface are configured such that the user's weight is essentially supported by the surrounding upper cushion surface whereas the depressed center is substantially non-body-weight-bearing and provides an upward force that contacts and supports a rectal area of a user when the toroidal cushion is sat upon.

11 Claims, 4 Drawing Sheets

DEVICES, SYSTEMS AND METHODS RELATING TO SEATING CUSHIONS FOR ALLEVIATION OF HEMORRHOIDS AND OTHER PURPOSES

PRIORITY CLAIM

The present application claims the benefit of U.S. Provisional Patent Application No. 61/473,629, filed Apr. 8, 2011, which application is incorporated herein by reference in its entirety.

BACKGROUND

Hemorrhoids and other pain associated with the rectal and rear area have been an ongoing problem for millennia. Many different systems, devices and procedures have been provided over the years in an attempt to alleviate/reduce the pain and/or reduce the symptoms associated with such conditions. However, even after these many years of trying, there has gone unmet a need for effective devices that are simple, usable by the common person, and effective at alleviating both symptoms and discomfort associated with hemorrhoids and other conditions. The present devices, systems and methods remedy one or more of these long-felt needs.

SUMMARY

As can be seen in the drawings and discussion herein, the present devices, systems, etc., are directed to a seating cushion or pillow configured to fit a human posterior and to help alleviate, i.e., reduce, pain and/or symptoms of hemorrhoids or other posterior-related conditions, as well as related methods of making and using such cushions. The cushions can also help reduce the amount and/or intensity of recurrences or flare-ups. The cushions are also very comfortable.

The cushions comprise a front and a back wherein there is a slight but significant downward slope from the back to the front. The cushions are substantially toroidal and therefore comprise a significant depression such as a divot or hole or in the middle of the cushion. In certain embodiments, the toroid is an oval, and the "doughnut hole" of the toroidal cushion need not be hollow all the way through, although such full-bore-hole configuration is typical where the cushion further comprises a cushion cover substantially, e.g., fully, encompassing the cushion.

The upper cushion surface for the "doughnut" of the cushion must be adequately taut across the opening or depression of the toroid or "doughnut" such that the upper cushion surface contacts and provides support for the rectal area of the user when in use. In particular, the upper cushion surface is adequately taut such that the rectal area of the user contacts the covering and is substantially supported thereby such that hemorrhoids, if present, are supported and not left to "dangle". This provides significant health advantages to hemorrhoid sufferers.

The back-to-front slope may progress in a relatively continuous manner from the front edge to the rear edge of the cushion or it may comprise only a substantial portion of the cushion from the back edge to the front edge, for example starting from about 50% from the back sloping down to about 20% from the front. The slope is relatively gradual, for example at about a five degree to 15 degree angle relative to horizontal. In certain embodiments, the front edge of the cushion is approximately one to three inches thick while the back edge of the cushion is approximately two to five inches thick.

In the event that the cushion is a full toroid (i.e., completely hollow in the "doughnut hole" area of the torus), and preferably regardless of whether the center of the toroid is hollow, the system further includes a cushion cover substantially, tautly covering the hollow of the cushion toroid from side to side and front to back. The cushion cover can be applied to the cushion and retained on the cushion using any desirable approach, such as buttons, zippers, snaps, Velcro™ (i.e., a hook and loop fastener), etc. The cushion cover can be made from any suitable material, typically a resilient, tough fabric such as cotton, polyester, etc.

Preferably, the upper cushion surface, be it the cushion cover or the cushion itself if no extra cover is provided, has a desired frictional quality (coefficient of friction) such that slipping off the cushion is impeded yet the user can still move freely on the cushion to reposition him/herself as desired.

The interior of the cushion can be made of any suitable stuffing, including, for example, natural fibers such as cotton, wood fibers, flax, seed husks, etc., or non-natural fibers such as polyester or rayon. The cushion is generally sized and shaped to fit a human posterior.

The cushion is also typically configured in an oval shape wherein the front-to-back of the cushion is the relatively narrow portion of the oval while the side-to-side portion of the cushion is the relatively wide portion of the oval. For example, the front-to-back dimension of the cushion can be from about 11 to 24 inches, and more typically around 12, 13 or 14 to 18 inches, while the side-to-side dimension of the cushion can be from about 14 to 28 inches, and more typically around 15.5 to 20 inches.

These and other aspects, features and embodiments are set forth within this application, including the following Detailed Description and attached drawings. In addition, various references are set forth herein, including in the Cross-Reference To Related Applications, that discuss certain systems, apparatus, methods and other information; all such references are incorporated herein by reference in their entirety and for all their teachings and disclosures, regardless of where the references may appear in this application.

DETAILED DESCRIPTION

Figure 1:
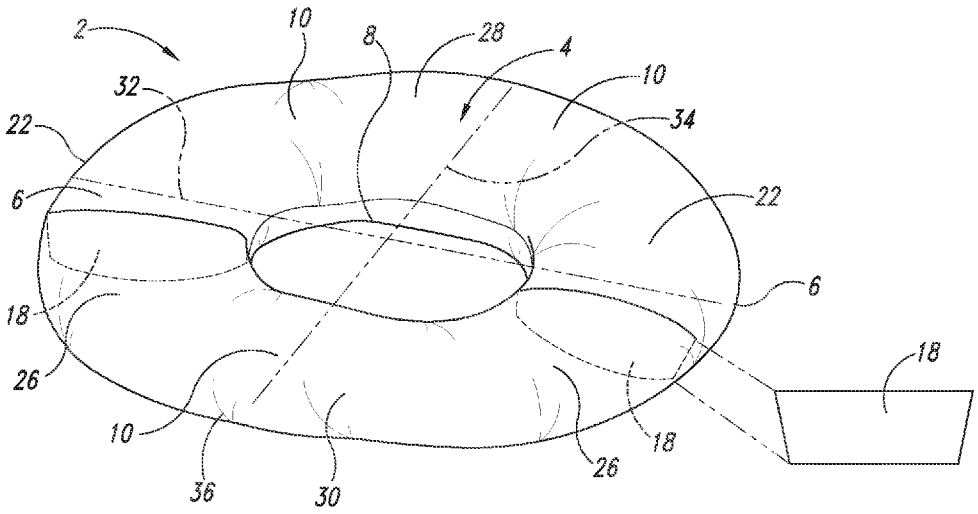
FIG. 1 depicts a perspective view of one embodiment of a cushion as discussed herein without its top covering.
Figure 2:
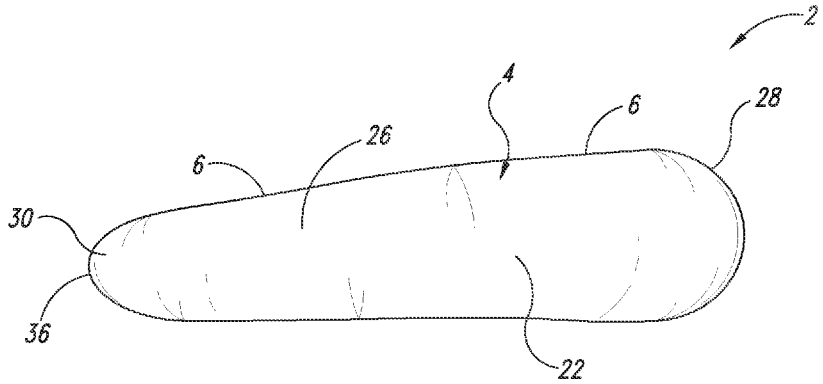
FIG. 2 depicts a side plan view of the embodiment shown in FIG. 1.
Figure 3:
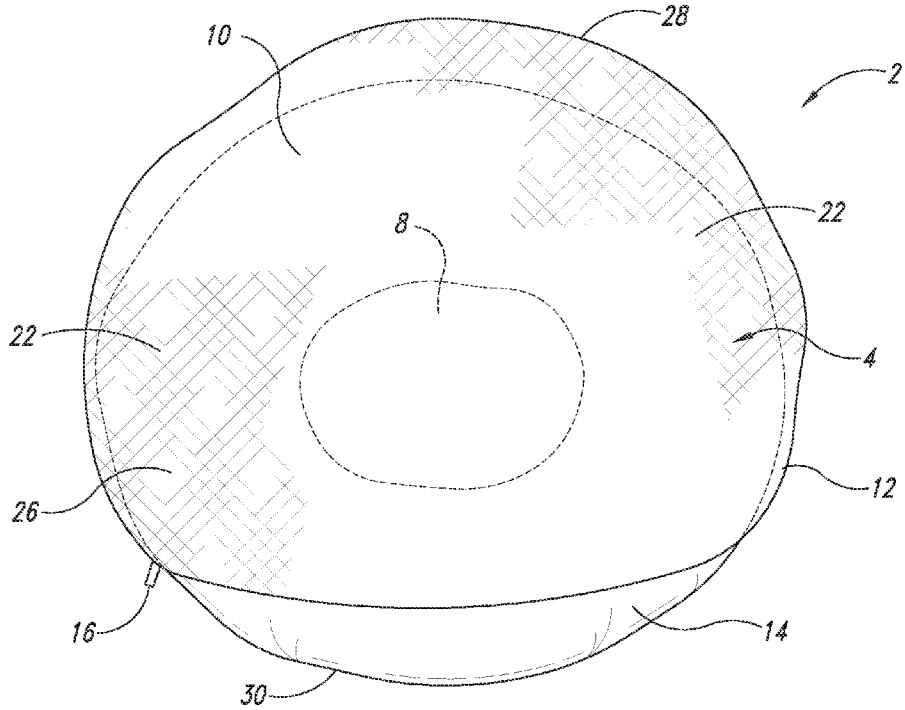
FIG. 3 depicts a top plan view of the embodiment shown in FIG. 1 with a top covering partially covering an inner toroid of an exemplary cushion herein.

Turning to the figures, FIGS. 1-3 depict views of one embodiment of a toroidal cushion 2 as discussed herein with and without its top covering 12. The seating cushion system shown comprises a toroidal cushion 2 sized to fit and support a posterior of a human user. The toroidal cushion 2 slopes 6 significantly from the back 28 toward the front 30 of the toroidal cushion 2. The toroidal cushion 2 comprises an upper cushion surface 4 comprising a depressed center 8 within a surrounding upper cushion surface 10. The depressed center 8 and the surrounding upper cushion surface 10 are configured such that the user's weight is essentially supported by the surrounding upper cushion surface 10 whereas the depressed center 8 is substantially non-body-weight-bearing and provides an upward force that contacts and supports a rectal area of a user when the toroidal cushion 2 is sat upon.

The toroidal cushion 2 can comprise an inner toroid 14 and a cushion cover 12 that is a separate piece of fabric. The depressed center 8 of the inner toroid 14 can be hollow as in FIGS. 1-3 or not fully or entirely hollow, as in FIGS. 4-5. The cushion cover 12 spans at least the depressed center 8 to tautly provide a surface across the depressed center 8 that provides the upward force that contacts and supports a rectal area of a user when the toroidal cushion 2 is sat upon. The cushion cover 12 can comprise any suitable attachment or closure device such as zipper 16.

The toroidal cushion 2 in these figures is oval with a long axis 32 of the oval extending side-to-side and a short axis 34 extending back-to-front. The toroidal cushion 2 can be about 12 to 15 inches from front to back, and 15 to 19 inches from side to side. The toroidal cushion 2 can also be from about 3 to 4 inches thick at the back and from about 1.5 to 2 inches thick at the front.

The toroidal cushion 2 can also comprise a plurality of dividers 18 configured to create a plurality of separate zones within the cushion with different heights of filler material 20 to create the slope 6. At least two of the dividers 18 can be located within opposed side portions 22 of the cushions. At least two of the dividers 18 are located within forward sections 26 of the opposed side portions 22 of the cushions and are disposed less than 180° from each other. In some embodiments, the dividers 18 are angled relative to perpendicular within the cushion.

Figure 4:
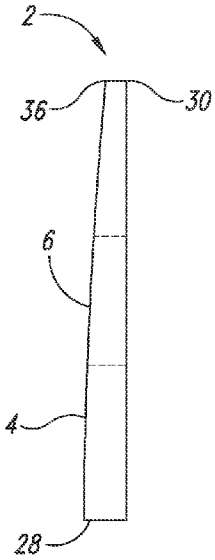
FIG. 4 depicts a side plan view of a further embodiment of a cushion as discussed herein.
Figure 5:
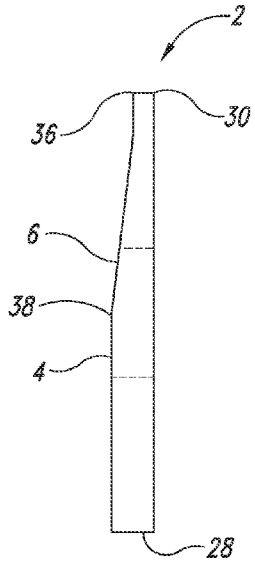
FIG. 5 depicts a side plan view of another embodiment of a cushion as discussed herein.

As shown in FIG. 2 the slope 6 begins at about 1 inch from the front of the toroidal cushion 2 and extends back to about 2 inches from the rear of the toroidal cushion 2. As shown in FIG. 4, the slope 6 from front to back can be substantially continuous, or as shown in FIG. 5, the slope 6 from front to back can begin about 2 inches to the rear of the front edge 36 of the toroidal cushion 2 and extend rearwardly to about the midway point 38 of the toroidal cushion 2. The toroidal cushion 2 is filled with a polyester stuffing or a natural filler material 20.

Figure 6:
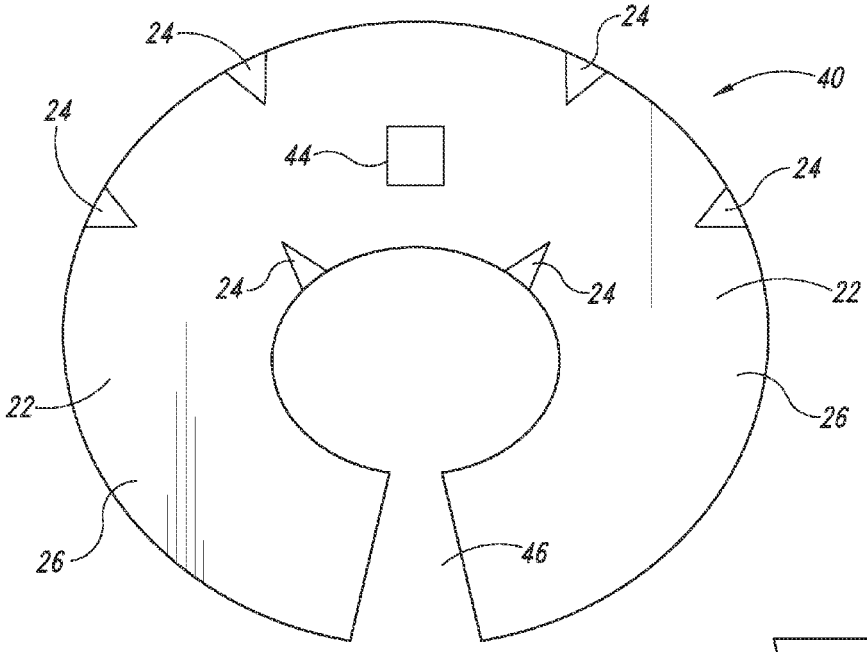
FIG. 6 depicts a top plan view of a pattern for a top portion of an inner toroid for an exemplary cushion herein.
Figure 7:
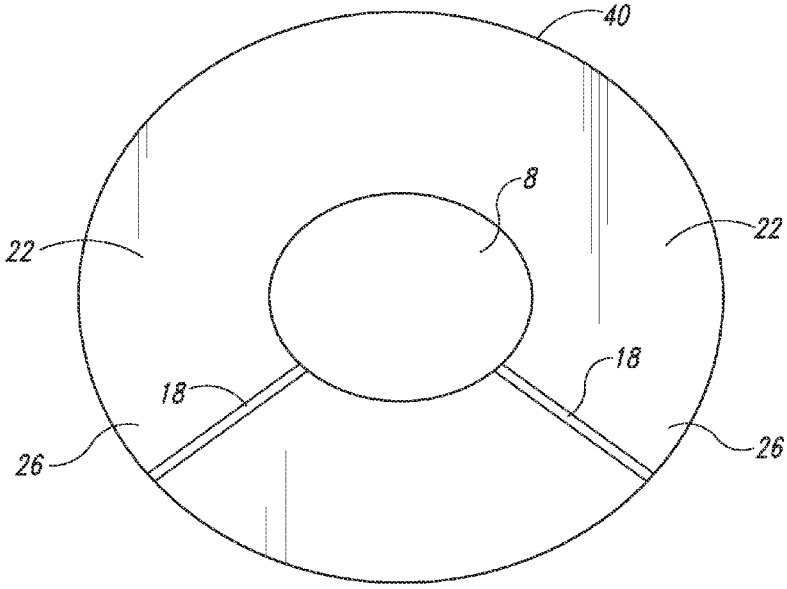
FIG. 7 depicts a top plan view of a pattern for a bottom portion of an inner toroid for an exemplary cushion herein.

FIG. 6 depicts a top plan view of a pattern 40 for a top portion 48 of an inner toroid 42 for an exemplary cushion 2 herein. FIG. 7 depicts a bottom plan view of a pattern 40 for a bottom portion 50 of the inner toroid 42 of FIG. 6. The pattern includes darts 24, label 44 and dividers 18. In the embodiment shown, two dividers 18 are located in opposed forward sections 26 of side portions 22. Cut out 46 reflects the fact that the top portion 48 is smaller than the bottom portion 50 to provide for the forward slope of the toroidal cushion 2.

Figure 8:
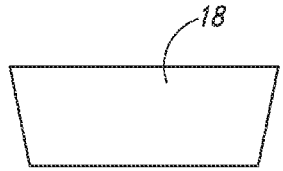
FIG. 8 depicts a side plan view of a cushion divider as discussed herein.

FIG. 8 depicts a side plan view of a cushion divider 18 as discussed herein.

Figure 9:
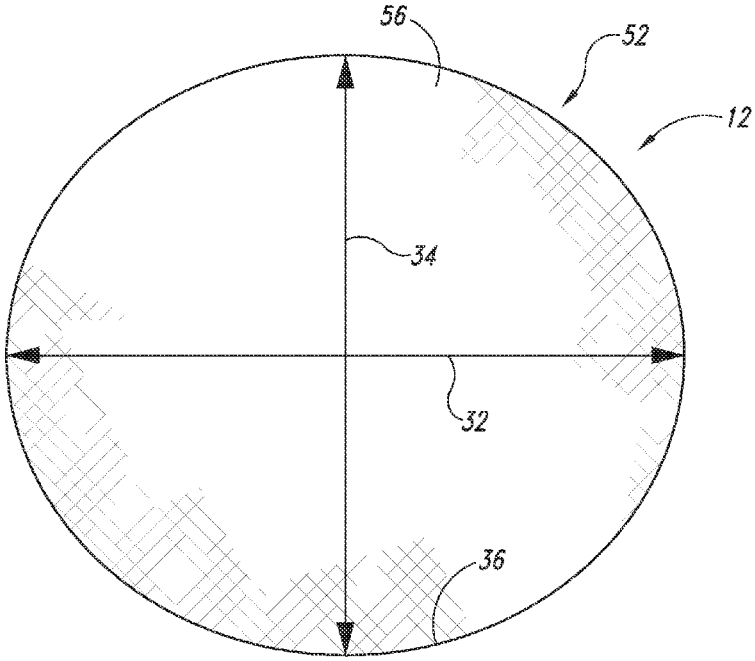
FIG. 9 depicts a top plan view of a pattern for a bottom or top portion of a cushion cover for an exemplary cushion herein.
Figure 10:
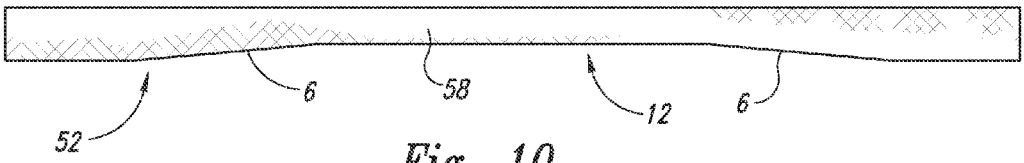
FIG. 10 depicts a plan view of a pattern for a front portion of a cushion cover that connects the top and bottom portions of a cushion cover for an exemplary cushion herein.
Figure 11:
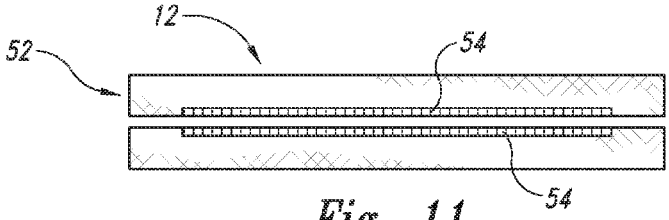
FIG. 11 depicts a plan view of a pattern for a rear portion of a cushion cover that connects the top and bottom portions of a cushion cover for an exemplary cushion herein.

FIGS. 9-11 depicts views of a pattern 52 for a cushion cover 12 for an exemplary cushion 2 herein. FIG. 9 depicts the top or bottom piece 56, which can be identical as depicted. FIG. 10 depicts a plan view of a pattern for a front piece 58 of a cushion cover 12 that connects the top and bottom pieces 56 of the cushion cover 12. Slopes 6 correlate to the slope of toroidal cushion 2. FIG. 11 depicts a plan view of a pattern 52 for a rear piece 58 of a cushion cover 12 that connects the top and bottom pieces 56 of the cushion cover 12, including zipper cut outs 54.

The aspects herein also include methods comprising either or both making or using of the toroidal cushion embodiments discussed herein. For example, the cushions can be used to alleviate hemorrhoid symptoms such as hemorrhoid pain. Such methods can comprise identifying a person as having hemorrhoid symptoms and/or pain, then having the person suffering the hemorrhoids sit on the toroidal cushion 2 as desired.

All terms herein are used in accordance with their ordinary meanings unless the context or definition clearly indicates otherwise. Also unless expressly indicated otherwise, the use of "or" includes "and" and vice-versa. Non-limiting terms are not to be construed as limiting unless expressly stated, or the context clearly indicates, otherwise (for example, "including," "having," and "comprising" typically indicate "including without limitation"). Singular forms, including in the claims, such as "a," "an," and "the" include the plural reference unless expressly stated, or the context clearly indicates, otherwise.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "means" is specifically recited in a claim.

From the foregoing, it will be appreciated that, although specific embodiments have been discussed herein for purposes of illustration, various modifications may be made without deviating from the spirit and scope of the discussion herein. Accordingly, the systems and methods, etc., include such modifications as well as all permutations and combinations of the subject matter set forth herein and are not limited except as by the appended claims or other claim having adequate support in the discussion and figures herein.

What is claimed is:

1. A seating cushion system comprising:

a toroidal cushion sized to fit and support a posterior of a human user, the cushion sloping significantly from the back toward the front of the cushion and comprising a depressed center within a surrounding upper cushion surface, wherein the toroidal cushion is oval with a long axis of the oval extending sick-to-side and a short axis extending back-to-front, the depressed center and the surrounding upper cushion surface configured such that the user's weight is essentially supported by the surrounding upper cushion surface and the depressed center provides an upward force that contacts and supports a rectal area of a user when the cushion is sat upon.

2. The cushion of claim 1 wherein the toroidal cushion comprises an inner toroid and a cushion cover that is a separate piece of fabric, wherein the depressed center of the inner toroid is hollow and the cushion cover spans at least the depressed center to tautly provide a surface across the depressed center that provides the upward force that contacts and supports a rectal area of a user when the cushion is sat upon.

3. The cushion of claim 1 wherein the cushion is about 12 to 15 inches from front to back, and 15 to 19 inches from side to side.

4. The cushion of claim 1 or 2 wherein the cushion is from about 3 to 4 inches thick at the back and from about 1.5 to 2 inches thick at the front.

5. The cushion of claim 1 or 2 wherein the slope begins at about 1 inch from the front of the cushion and extends back to about 2 inches from the rear of the cushion.

6. The cushion of claim 1 or 2 wherein the cushion is filled with a polyester stuffing.

7. The cushion of claim 1 or 2 wherein the cushion is filled with a natural filler material.

8. The cushion of claim 1 or 2 wherein the cushion comprises a plurality of dividers configured to create a plurality of separate zones within the cushion with different heights of filler material to create the slope.

9. The cushion of claim 8 wherein at least two of the dividers are located within opposed side portions of the cushions.

10. The cushion of claim 8 wherein the at least two dividers are located within forward sections of the opposed side portions of the cushions and are disposed less than 180° from each other.

11. The cushion of claim 8 wherein the dividers are angled relative to perpendicular within the cushion.

* * * * *